US006988347B2

(12) United States Patent
Nanayakkara

(10) Patent No.: US 6,988,347 B2
(45) Date of Patent: Jan. 24, 2006

(54) METAL STUD FRAME ELEMENT

(76) Inventor: Lakdas Nanayakkara, 2211 NE. 54th St., Fort Lauderdale, FL (US) 33308

( * ) Notice: Subject to any disclaimer, the term of this patent is extended or adjusted under 35 U.S.C. 154(b) by 0 days.

(21) Appl. No.: 10/642,634

(22) Filed: Aug. 19, 2003

(65) Prior Publication Data

US 2004/0134160 A1 Jul. 15, 2004

Related U.S. Application Data

(62) Division of application No. 09/480,133, filed on Jan. 10, 2000, now Pat. No. 6,615,563.

(51) Int. Cl.
*E04C 3/30* (2006.01)

(52) U.S. Cl. ..... 52/731.7; 52/733.2; 52/733.3; 52/648.1; 52/649.1; 52/649.2; 52/653.1

(58) Field of Classification Search ..... 52/731.1, 52/731.4, 731.5, 731.7, 731.8, 731.9, 733.2, 52/733.3, 356, 481.1, 633, 637, 648.1, 649.1, 52/649.2, 649.3, 650.1, 651.1, 653.1, 659
See application file for complete search history.

(56) References Cited

U.S. PATENT DOCUMENTS 1,130,722 A * 3/1915 Fletcher ..... 52/355
1,313,581 A * 8/1919 Collins ..... 52/356
1,936,147 A * 11/1933 Young ..... 52/334
2,105,771 A * 1/1938 Holdsworth ..... 52/290
2,209,514 A * 7/1940 Drummond ..... 52/223.13
4,885,884 A * 12/1989 Schilger ..... 52/354
5,157,883 A * 10/1992 Meyer ..... 52/357
5,315,804 A * 5/1994 Attalla ..... 52/731.1

* cited by examiner

*Primary Examiner*—Jeanette E. Chapman
(74) *Attorney, Agent, or Firm*—M. K. Silverman

(57) ABSTRACT

A metallic stud for use in a framing structure, the stud definable in terms a x, y, z coordinate system. The stud includes the z-axis elongate substantially rectangular integral web within a yz plane and further includes a series of xz plane tabs projecting in an x-axis direction, the tabs alternating in x-axis extent between interdigitating greater and lesser dimensions, in which a z-axis line of dependency exists between a common xz plane of all of the tabs in a first major rectangular base of the yz plane of the web of the stud. The stud further includes a z-axis elongate L-shaped element integrally dependent from a second major rectangular base of the web, the elongate element parallel to the first base. The element includes an integral xz plane sub-element, extending in a z-axis direction, and substantially parallel with the series of xz plane tabs from a z-axis line of dependency from the second major base of the web, the z-axis L-shaped element further including a yz plane sub-element, in the nature of a lip, integrally depending from the xz sub-element along an entire z-axis length and projecting toward the series of xz plane tabs, in which the yz sub-element is substantially parallel with the yz plane of the elongate web. The studs are preferably formed of a thin gauge steel.

12 Claims, 8 Drawing Sheets

METAL STUD FRAME ELEMENT

REFERENCE TO RELATED APPLICATION

This is a divisional of application Ser. No. 09/480,133, filed on Jan. 10, 2000, now U.S. Pat. No. 6,615,563.

BACKGROUND OF THE INVENTION

The present invention relates to metallic stud frames of a type used in the formation of a frame of a residential or commercial structure.

Historically, frames of such structures were formed of either wood, steel or concrete. In the case of load bearing structures, it is common to use a steel bar, know as rebars within a poured concrete structure. The use of vertical light gauge steel studs, in lieu of wooden studs to accomplish internal framing within a wood frame structure, is also well known in the art.

It is, however, not known to employ thin gauge vertical studs in combination with exterior wall concrete framing in which the vertical stud operates to define an offset the distance between an exterior poured concrete wall and an interior plasterboard wall which is secured to one surface of such a vertical steel stud.

A need for such a vertical steel stud frame element has arisen as a consequence of rapid on-site assembly high techniques employing thin external concrete walls which have developed in the construction arts. The present invention therefore relates to such vertical metallic stud in which one rectilinear surface thereof may be poured as a part of a process of casting of an exterior concrete wall, its base and/or load bearing of the resultant structure.

SUMMARY OF THE INVENTION

The instant invention relates to a metallic stud for use in a framing structure, the stud definable in terms a x, y, z coordinate system. The stud, more particularly, includes the z-axis elongate substantially rectangular integral web within a yz plane thereof and further includes a series of xz plane tabs projecting in an x-axis direction, said tabs alternating in x-axis extent between interdigitating greater and lesser dimensions thereof, in which a z-axis line of dependency exists between a common xz plane of all of said tabs in a first major rectangular base of said yz plane of said web of said stud. Said stud further includes a z-axis elongate L-shaped element integrally dependent from a second major rectangular base of said web, said elongate element parallel to said first base thereof. Said element includes an integral xz plane sub-element, extending in a z-axis direction, and substantially parallel with said series of xz plane tabs from a z-axis line of dependency from said second major base of said web, said z-axis L-shaped element further including a yz plane sub-element, in the nature of a lip, integrally depending from said xz sub-element along an entire z-axis length thereof and projecting toward said series of xz plane tabs, in which said yz sub-element is substantially parallel with said yz plane of said elongate web. The stud preferably formed of a thin gauge steel.

It is accordingly an object of the present invention to provide a metallic stud framing element particularly adapted for use within a concrete framing structure.

It is another object to provide a metallic stud of the above type which can function as an interior to exterior wall defining offset.

It is a further object of the invention to provide a vertical metallic stud capable of defining the shape and extent of vertical load bearing concrete columns within a poured concrete structure.

The above and yet other objects and advantages of the present invention will become apparent from the hereinafter set forth Brief Description of the Drawings, Detailed Description of the Invention and claim appended herewith.

DETAILED DESCRIPTION OF THE INVENTION

Figure 1:
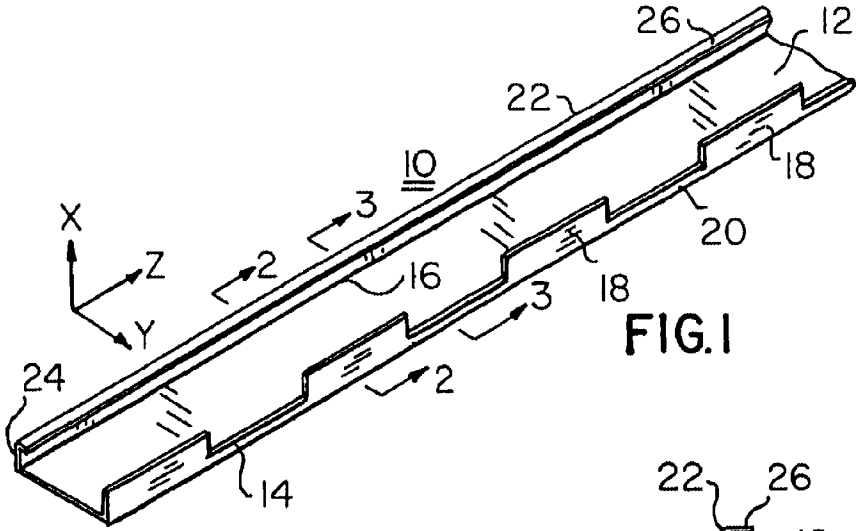
FIG. 1 is a perspective view of an inventive metallic stud.

With reference to the perspective view of FIG. 1, the present inventive metallic stud for use in the framing of structures may be seen to be definable in an x,y,z coordinate system which is shown as a part of FIG. 1.

More particularly, an inventive stud 10 may be seen to include an integral web 12 having a z-axis elongate structure, which is substantially rectangular. Web 12 includes a first major base 14 and an opposing second major base 16, which bases are substantially parallel with each other. See also FIGS. 2 and 3.

Figure 2:
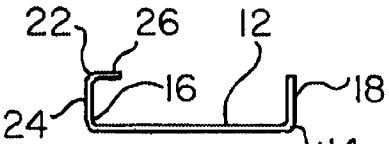
FIG. 2 is a transverse cross-sectional view taken through Line 2—2 of FIG. 1.
Figure 3A:
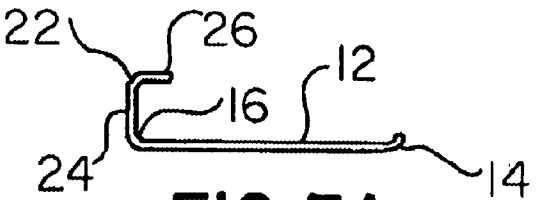
FIG. 3 is a transverse cross-sectional view taken through Line 3—3 of FIG. 1.
Figure 3:
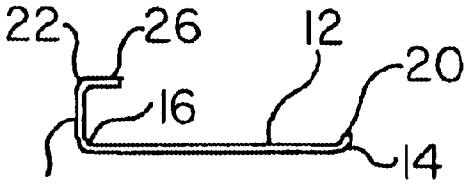

The instant framing stud may, with reference to FIGS. 1 and 2, be further seen to include a series of xz plane tabs 18 and 20 which project into an x-axis direction. It is, however, noted that said tabs 18 alternate in x-axis extent between interdigitating greater dimensions said (said tabs 18) and lesser dimensions (tabs 20) of said series. It is noted that a z-axis line of dependency, which is co-linear with said first major rectangular base 14, exists between an xz plane which is common to all of said tabs 18 and 20 and the yz plane of said integral web 12.

With reference to the opposite side of stud 10, there is provided a z-axis elongate L-shaped element 22 which is integrally dependent from said second major rectangular base 16 along a z-axis line of dependency therefrom. As may be further noted, said element is bi-planar and, therefrom, includes an elongate integral xz plane sub-element 24 which extends into a z-axis direction and which is substantially parallel with said interdigitating series of tabs 18 and 20. Said L-shaped element 22 further includes a yz plane sub-element 26 which is also z-axis elongate, but which projects in the direction of said tabs 18 and 20, and is preferably parallel with the plane of web 12.

Figure 2B:
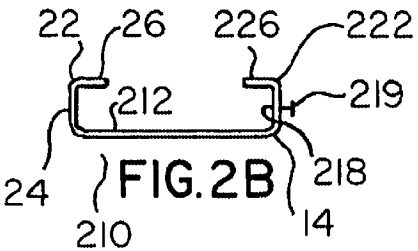
FIG. 2B is a transverse cross sectional view, similar to the view of FIG. 2, however, showing a third embodiment of the inventive metallic stud.
Figure 2A:
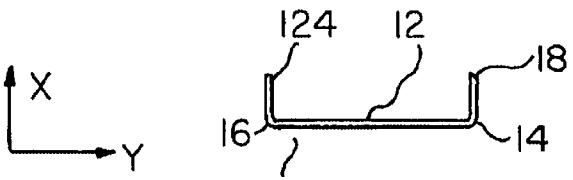
FIG. 2A is a transverse cross-sectional view, similar to the view of FIG. 2, however, showing a second embodiment of the present invention.
Figure 2D:
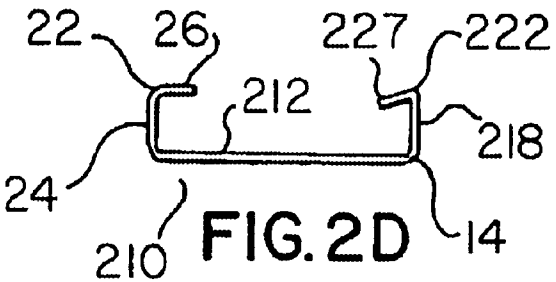
FIG. 2D is a transverse cross-sectional view, similar to the view of FIG. 2, however, showing a further embodiment of the metallic stud.

Shown in FIG. 2A is a second embodiment of the invention which differs from the preferred embodiment, shown and described with reference to FIGS. 1 and 2 above, in that said yz plane sub-element 26 of the L-shaped element 22 is not employed. Accordingly, as may be noted in FIG. 2 and 2A, in the second embodiment of the invention, the right sides of the respective figures is the same. However, with respect to L-shaped element 124 of the second embodiment, namely, stud frame element 110, there exists only an integral xz plane sub-element 124. Accordingly, in this embodiment, the stud frame element is symmetrical about a xz plane of symmetry.

With reference to FIG. 2B there is, therein, shown a third embodiment of the invention, namely, metallic stud frame 210 in which the left hand side thereof is identical to the left hand side of the embodiment of FIG. 2. However, at the right hand portion thereof, there is provided an L-shaped member 222 which is symmetric with L-shaped element 22 at the left side of FIG. 2B. Said L-shaped element 222 includes an elongate xz plane sub-element 218 which is integrally dependent from web 212 at first major base 14 of web 212. Extending integrally in a yz plane from sub-element 218 is a yz plane sub-element 226 which is substantially symmetric with said yz plane sub-element 26 of element 22, above discussed. However, in the embodiment of FIG. 2B, there are further provided projecting substantially T-shaped elongate elements 219 which are z-axis longitudinal with respect to each of the sub-elements 218 from which they project in the positive y-axis direction.

Figure 2C:
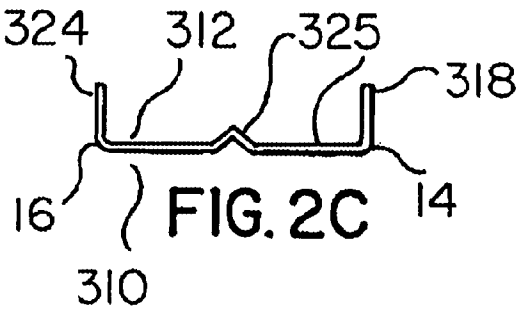
FIG. 2C is a transverse cross-sectional view, similar to the view of FIG. 2, however, showing a fourth embodiment of the metallic stud.

With reference to the embodiment of FIG. 2C, it is noted that web 12 of the prior embodiments is replaced by a web 312 which is characterized by a by a longitudinal crimp 325 which may, in cross section, resemble a triangle, as is shown in FIG. 2C. This embodiment provides for compressibility between xz surface 318 and 324 of the metallic stud frame. Accordingly, the embodiment of FIG. 2C provides for a stud frame element which is capable of absorbing compressive forces, along the y-axis which may then be absorbed by crimp 325 within web 312.

Figure 4:
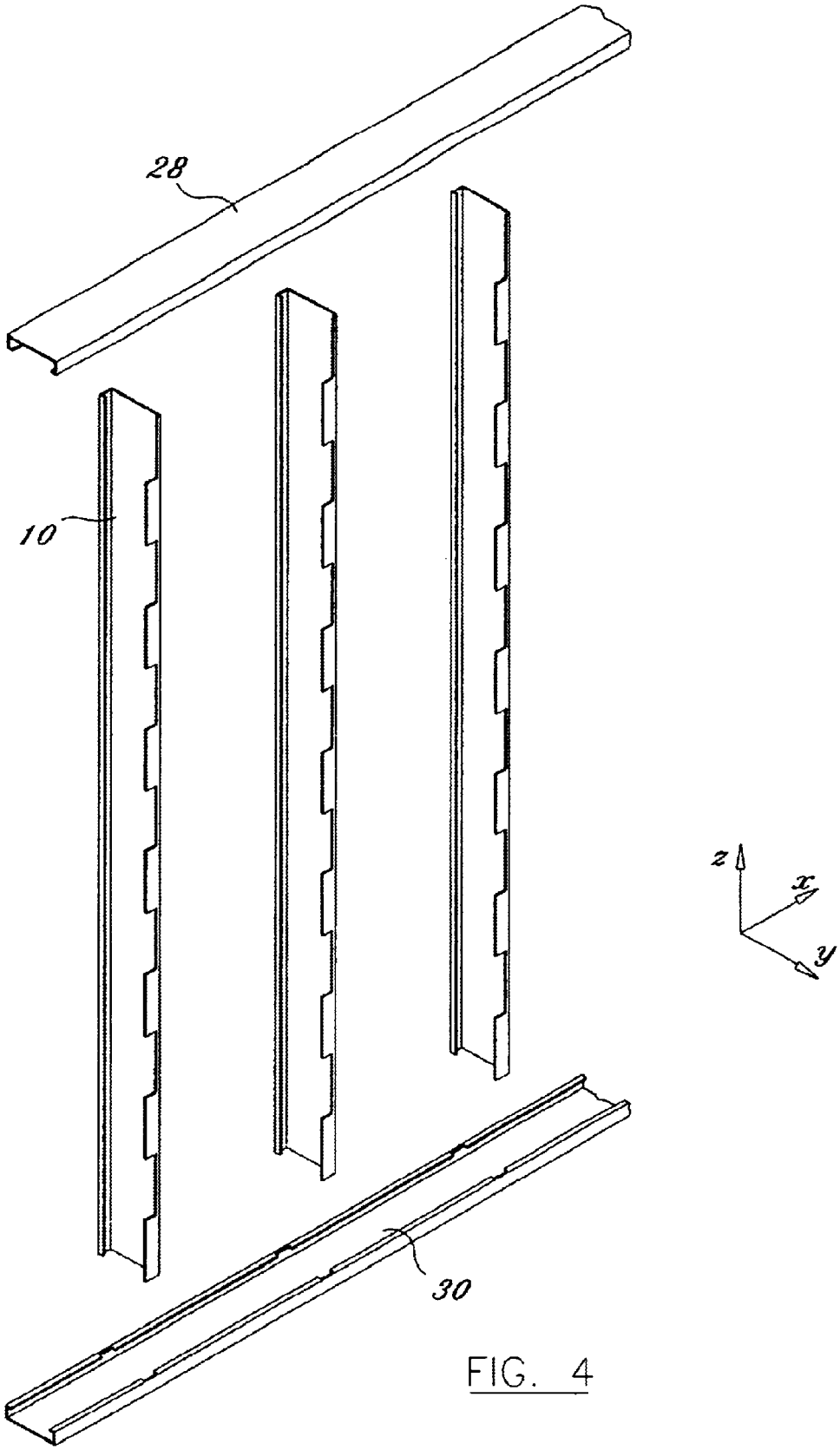
FIG. 4 is an exploded view showing the stud frame of FIG. 1 in combination with upper and lower system framing elements.
Figure 5:
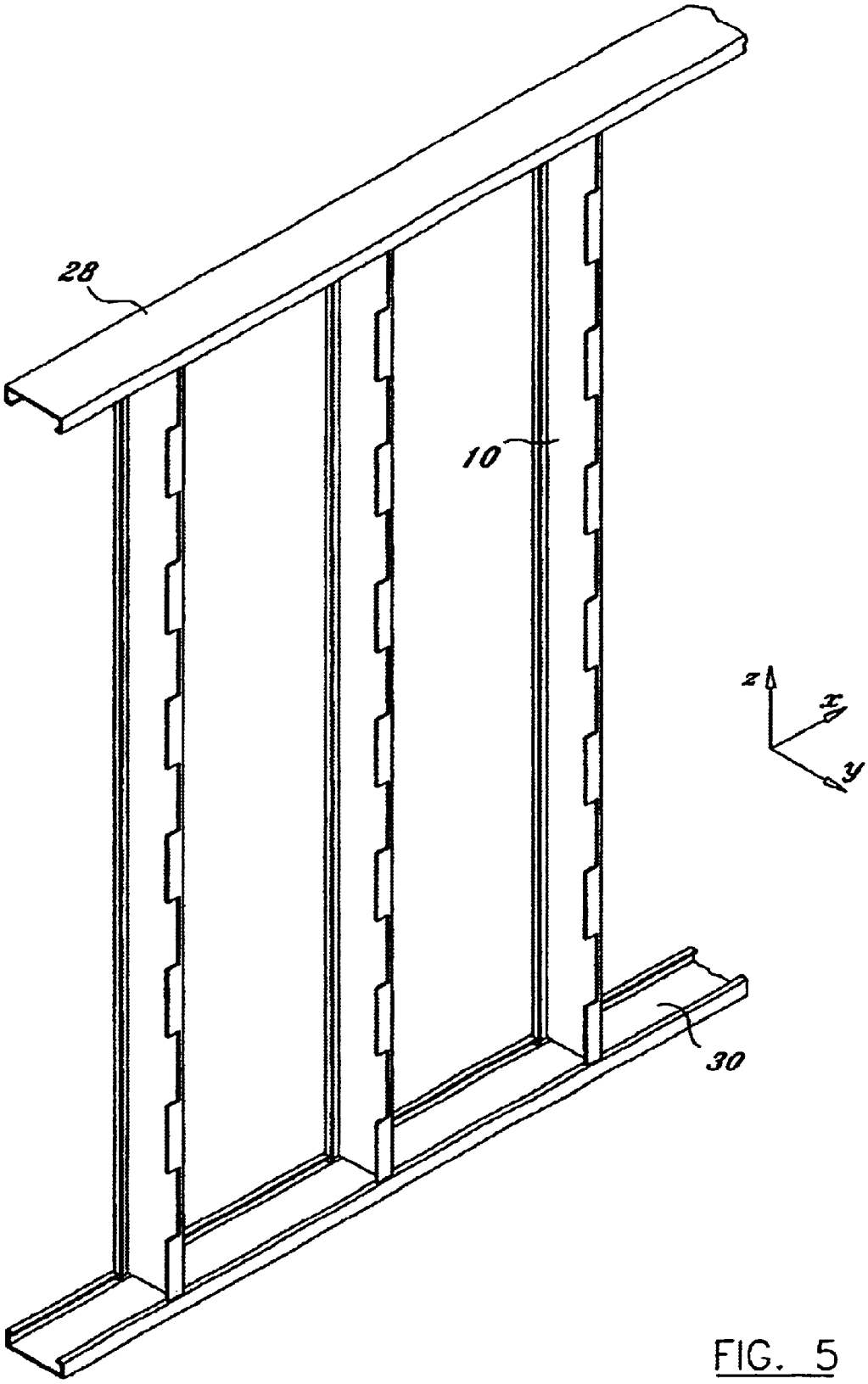
FIG. 5 is an assembly view of the exploded view of FIG. 4.

The fashion of integration of frame stud 10 into a larger structure may be seen with reference to the exploded view of FIG. 4 in which three of the inventive metallic studs 10 are shown in vertical position relative to horizontal framing members 28 and 30. In FIG. 5, the elements of FIG. 4 are shown in assembly view.

Figure 6:
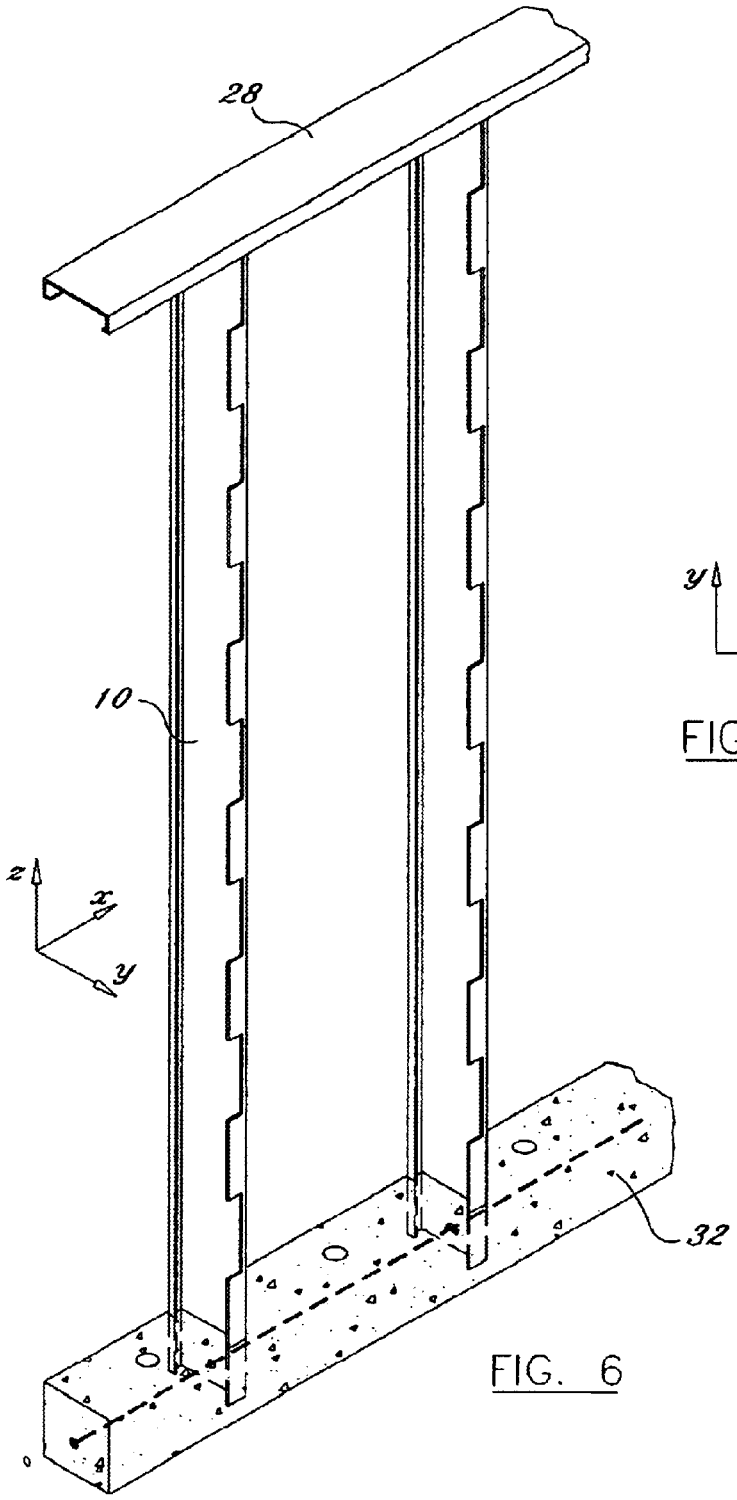
FIG. 6 is a view, further to the view of FIG. 5, in which a concrete base of a resultant structure has been formed.

In FIG. 6, the structure of FIG. 5 is shown, however, with the addition of a horizontal concrete footing 32.

Figure 8:
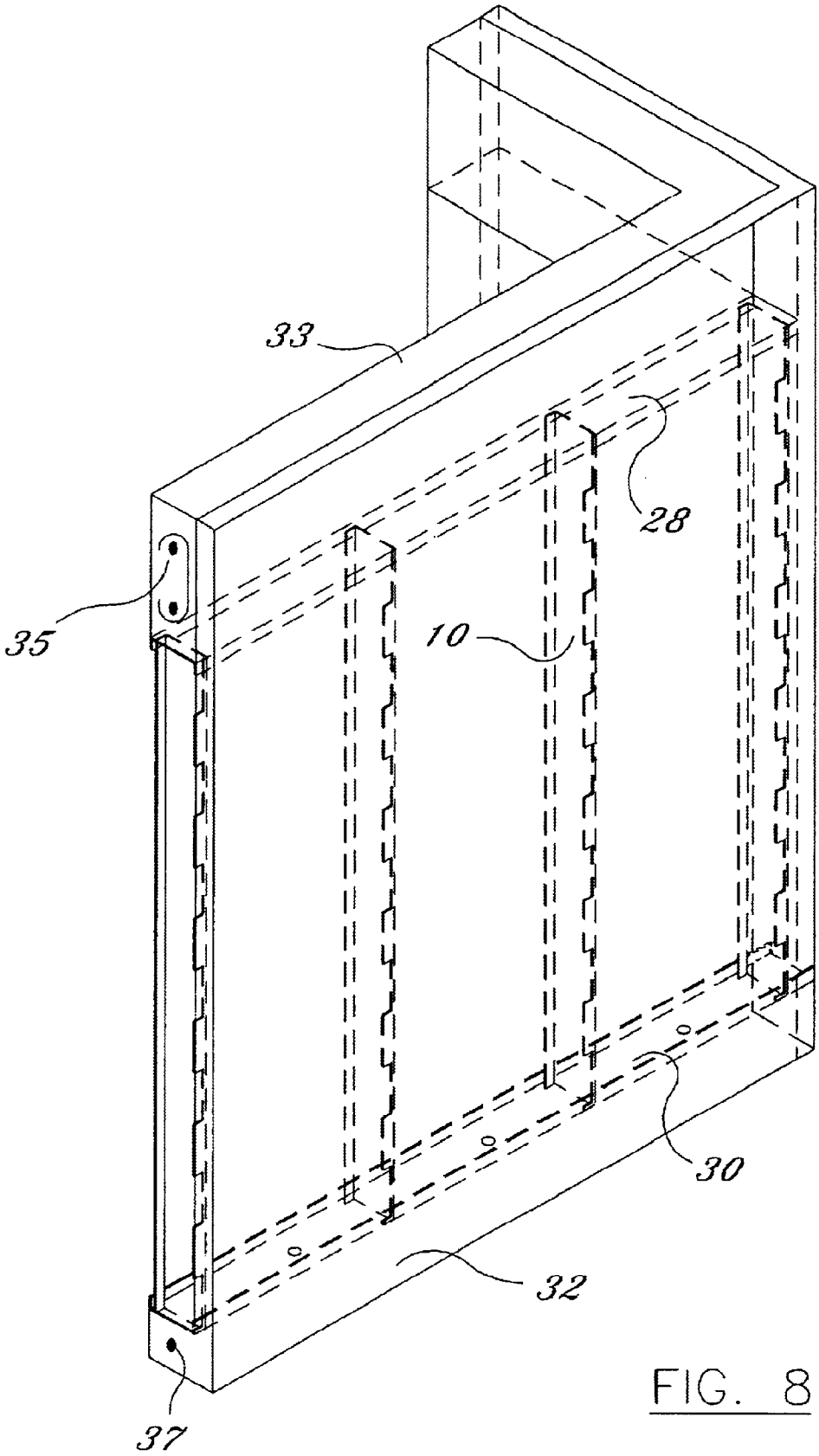
FIG. 8 is a view, further to the view of FIG. 6, in which a concrete capstan of a resultant structure has been formed.
Figure 9:
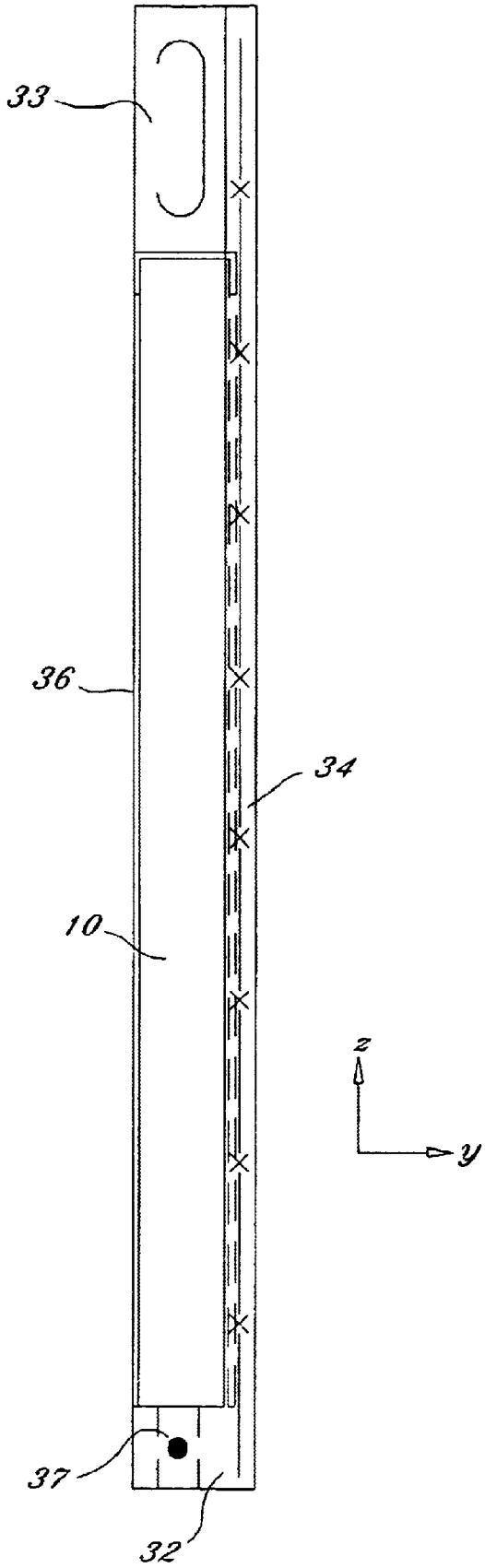
FIG. 9 is a yz plane side view of FIG. 8.

The view of FIG. 8 is further to that of FIG. 6 in which a resultant structure, including a capstan 33, is shown which is cast over horizontal finishing members 28 and 30. Further shown in FIG. 8 are rebars 35 within said capstan, and rebar 37 with footing 32. FIG. 9 is a yz end plan view of FIG. 8, showing the vertical relationship between stud 10 and inner and outer walls of 36 and 34 respectively of a resultant framed structure. Shown within outer wall 34 is wire mesh 41.

Figure 7:
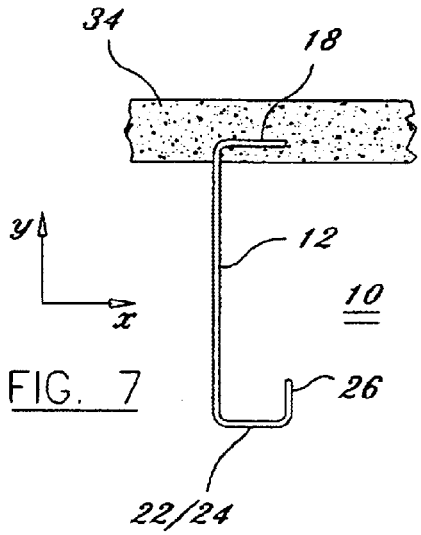
FIG. 7 is a fragmentary bottom horizontal sectional view of a resultant structure showing a xz plane tab of the inventive stud wholly embedded within a poured concrete exterior wall.
Figure 10:
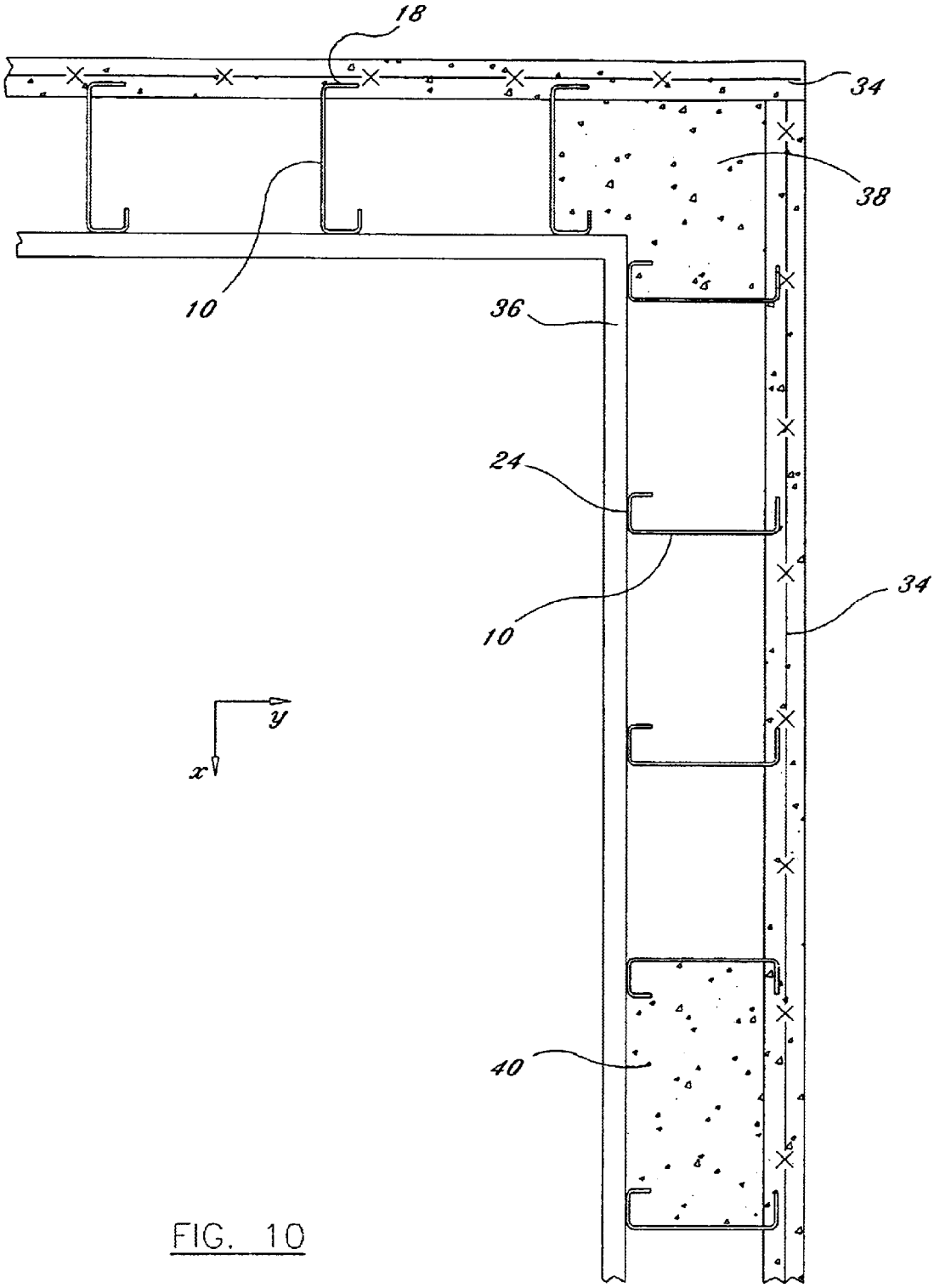
FIG. 10 is a horizontal cross-sectional view of a wall of a structure, further to FIGS. 6 to 7, showing the positioning of steel stud frame elements relative to a poured concrete wall, interior vertical poured concrete columns and interior plasterboard connected to a curved surface of the stud frame.

In FIG. 7 is shown the manner In which tabs 18 of the metallic stud 10 are wholly embedded within a thin concrete wall 34, which forms an exterior of the structure to be framed. This may be fully seen with reference to FIG. 10 which comprises a horizontal (xy plane) cross section of a structure with which metallic studs 10 are employed, in FIG. 10 may be further seen the attachment of plaster boards 36 or the like to sub-elements 24 of the metallic stud 10. Such attachment is typically effected through screw attachment, although other means of securement. i.e., glue or adhesion may be employed. As may be further noted in FIG. 10, studs 10 may be used to form vertical molds within into which columns 38 and 40 may be poured to provide load bearing capability to the resultant structure.

The above described metal stud 10 constitutes a cost-effective means for rapid assembly of a large variety of structures which obviates entirely the need for wood, steel I-beams, or heavy steel rebars within concrete. Further, structures resultant from the use of stud 12 do not require large or massive quantities of concrete to produce a structure of suitable resistance to loads and stresses, both horizontally and vertically. In addition, because of vertical concrete columns, such as columns 38 and 40, may be formed through the use of the inventive metallic stud, traditional truss structures may be placed thereupon where special purpose roofing designs are required.

Stud 10 is preferably formed of a light gauge in a range of 16 to 25 gauge.

While there has been shown and described the preferred embodiment of the instant invention it is to be appreciated that the invention may be embodied otherwise than is herein specifically shown and described and that, within said embodiment, certain changes may be made in the form and arrangement of the parts without departing from the underlying ideas or principles of this invention as set forth in the claims appended herewith.

What is claimed is:

1. A construction system, comprising:

(a) a metallic stud definable in terms of an x, y, z, coordinate system, the system comprising:

(i) a z-axis elongate substantially rectangular integral web within a yz plane thereof;

(ii) a series of xz plane tabs projecting within a substantially x-axis direction, said tabs alternating in x-axis dimension between interdigiting greater and lesser dimensions thereof, in which a z-axis line of dependency exists between a common xz plane of all of said tabs and a first major rectangular base of said yz plane of said web of said stud; and (iii) a z-axis elongate L-shaped element integrally dependent from a second major rectangular base of said web, parallel to said first base thereof, said element including an elongate integral xz-plane sub-element extending in a substantially z-axis direction, and substantially parallel with said series of xz plane tabs, from a z-axis line of dependency from said second major base of said web, said L-shaped element further including a yz plane sub-element, in the nature of a lip, integrally depending from said first xz plane element along an entire z-axis length thereof, said second sub-element projecting toward said series of xz plane tabs;

(b) a concrete slab into which substantially all of said greater dimension xz plane tabs of said series thereof are wholly embedded therein prior to the hardening of said slab.

2. The system as recited in claim 1, in which said yz plane sub-element is substantially parallel with said yz plane of said web.

3. The system as recited in claim 1, in which a sub-element of said L-shaped element, in the nature of a lip, is not substantially parallel with said yz plane of said web.

4. The system as recited in claim 1, in which a relationship of a y-axis dimension of said web to an x-axis dimension of said tabs of greater dimension defines a ratio in a range of about 6:1 to about 2:1.

5. The metallic stud as recited in claim 4, in which x-axis dimensions of said L-shaped element and of said xz tabs are approximately equal to each other.

6. The system as recited in claim 4, in which an x-axis dimension of said tabs comprises substantially zero.

7. The system as recited in claim 4, in which a relationship of y-axis dimension of said yz plane sub-element of said L-shaped element to an x-axis dimension of said xz plane sub-element thereof defines a ratio in a range of about 1:1 to about 1:4.

8. The system as recited in claim 4, in which a relationship of a z-axis dimension of said tabs of greater dimension to an x-axis dimension thereof defines a ratio in a range of about 7:1 to about 1:1.

9. The system as recited in claim 7, in which a relationship of a z-axis dimension of said tabs of greater dimension to an x-axis dimension thereof defines a ratio In a range of about 7:1 to about 1:1.

10. A construction system, comprising:

(a) a metallic stud for use in the framing of structures, the stud definable in terms of an x, y, z coordinate system, the stud comprising (i) a z-axis elongate substantially rectangular integral web within a yz plane thereof;

(ii) a series of xz plane tabs projecting within a substantially x-axis direction, said tabs alternating in x-axis dimension between interdigiting greater and lesser dimensions thereof, in which a z-axis line of dependency exists between a common xz plane of all of said tabs and a first major rectangular base of said yz plane of said web of said stud; and (iii) a z-axis elongate L-shaped element integrally dependent from a second major rectangular base of said web, parallel to said first base thereof, said element including an elongate Integral xz-plane sub-element extending in a substantially z-axis direction, and substantially parallel with said series of xz plane tabs, from a z-axis line of dependency from said second major base of said web, and (b) a concrete slab into which substantially all of said greater dimension xz plane tabs of said series thereof are wholly embedded therein prior to the hardening of said slab.

11. The metallic stud as recited in claim 10, in which said rectangular integral web includes longitudinally disposed compressible crimp means along a z-axis of said Integral web, disposed between said xy plane tabs and said xz sub-elements of said stud.

12. A construction system comprising:

(a) a metallic stud for use in the framing of structures, the stud definable in terms of an x, y, z coordinate system, the stud comprising:

(i) a z-axis elongate substantially rectangular integral web within a yz plane thereof;

(ii) a series of xz plane tabs projecting within a substantially x-axis direction, said tabs alternating in x-axis dimension between interdigiting greater and lesser dimensions thereof, in which a z-axis line of dependency exists between a common xz plane of all of said tabs and a first major rectangular base of said yz plane of said web of said stud, and said xz plane tabs of greater dimension further including yz plane sub-elements, in the nature of lip, integrally depending from said xz plane tabs and projecting toward and parallel with said substantially rectangular yz plane web, in which said xz plane tabs of greeter dimension include z-axis elongate members projecting integrally from said xz plane tabs but In a direction away from said yz plane integral web; and (iii) a z-axis elongate L-shaped element integrally dependent from a second major rectangular base of said web, parallel to said first base thereof, said element including an elongate integral xz-plane sub-element extending in a substantially z-axis direction, and substantially parallel with said series of xz plane tabs, from a z-axis line of dependency from said second major base of said web, said L-shaped element further including a yz plane sub-element, in the nature of a lip, integrally depending from said first xz plane element along an entire z-axis length thereof, said second sub-element projecting toward said series of xz plane tabs; and (b) a concrete slab into which substantially all of said greater dimension xz plane tabs of said series thereof are wholly embedded therein prior to the hardening of said slab.

* * * * *